United States Patent [19]

Kunreuther

[11] 4,273,279

[45] Jun. 16, 1981

[54] HIGH STRENGTH NEEDLE ASSEMBLY WITH SHARPENABLE CUTTING EDGE

[76] Inventor: Steven Kunreuther, 285 Central Park W., New York, N.Y. 10024

[21] Appl. No.: 55,542

[22] Filed: Jul. 9, 1979

[51] Int. Cl.[3] ..... B65C 7/00

[52] U.S. Cl. ..... 227/67; 112/104

[58] Field of Search ..... 227/64, 67, 68; 112/104, 222; 223/104

[56] References Cited

U.S. PATENT DOCUMENTS

| | | | |
|---|---|---|---|
| Re. 29,310 | 7/1977 | Bone | 227/67 |
| Re. 29,819 | 10/1978 | Bone | 227/67 |
| 3,470,834 | 10/1969 | Bone | 227/67 |
| 3,759,435 | 9/1973 | Bone | 227/67 |
| 4,040,555 | 8/1977 | Jenkins | 227/67 |

FOREIGN PATENT DOCUMENTS

| | | | |
|---|---|---|---|
| 771750 | 4/1957 | United Kingdom | 112/222 |

*Primary Examiner*—John McQuade
*Attorney, Agent, or Firm*—James & Franklin

[57] ABSTRACT

The assembly includes a shank part having a tip and cylindrical hollow portion, a base part having a central bore and a knife part. The central bore has first and second sections, the first section having an inner diameter equal to the outer diameter of the cylindrical portion, such that the shank can be inserted therein and secured thereto by an adhesive. The second section has an inner diameter equal to the inner diameter of the cylindrical portion. The knife part includes a body portion with a cutting edge on one end and a protrusion on the other end, the protrusion being adapted to be received within and secured to a recess adjacent the second section of the bore. The knife part extends beyond the base in a direction substantially parallel to the axis of the base such that the cutting edge is accessible for resharpening.

25 Claims, 13 Drawing Figures

HIGH STRENGTH NEEDLE ASSEMBLY WITH SHARPENABLE CUTTING EDGE

BACKGROUND OF THE INVENTION

The present invention relates to the construction of a needle for use in dispensing fastener attachments or the like and, more particularly, to a needle assembly formed of multiple parts which is high in strength, low in cost and permits re-sharpening of the cutting edge.

Plastic fastener attachments are widely used throughout the wearing apparel and softgoods industries, as well as other industries, in order to attach labels or other items to products in a manner which prevents detachment thereof. Attachments of this type are normally made of nylon or similar high strength plastic and typically comprise a relatively thin filament connecting a T-bar end and a paddle end. Such attachments are commercially available from the Dennison Manufacturing Company of Framingham, Mass. in a number of different sizes, colors and styles.

The attachments are manufactured in clips typically containing fifty or a hundred attachments aligned in side-by-side relationship. The T-bar ends of the attachments are connected to a common runner bar. The attachments may be unconnected at their paddle ends or may be connected by various techniques to prevent tangling, as described in U.S. Pat. No. 3,733,657 issued May 22, 1973 to Gordon B. Lankton and entitled "Assembly of Attachments And Method of Manipulating The Same".

The clips of attachments are designed for use in a dispensing device known as an "attacher" or "gun". Various types of attachers or guns are known to the art and commercially available. For instance, U.S. Pat. Nos. 3,470,834; 3,759,435; U.S. Pat. No. Re. 29,310; and, U.S. Pat. No. Re. 29,819, all of which were issued to Arnold R. Bone, illustrate a number of different manually actuatable attachers or guns. In addition, a variety of different power actuated attachers or guns are also commercially available from sources such as Dennison Manufacturing Company of Framingham, Mass.

All of the attachers or guns comprise a body into which a slotted, hollow needle is mounted. The clip of attachments is inserted into the gun behind the needle. Actuation of the gun causes a plunger, aligned with the T-bar end of the first attachment in the clip, to be displaced forwardly, such that the first attachment in the clip is dispensed. Each attachment in the clip is automatically aligned with the needle in sequence prior to dispensing same.

In order to attach a tag to a garment or the like, the gun is loaded with a clip of attachments and the needle is caused to penetrate the label and the garment. The gun is then actuated, such that the T-bar end of the attachment is pushed by the plunger through the hollow needle and is situated at the rear of the garment. The needle is then withdrawn leaving the attachment with the T-bar end on one side of the garment and label, and the paddle end of the attachment on the other side of the garment and the label, such that the label is attached to the garment.

The T-bar end of each of the attachments in the clip must be severed from the clip as same is dispensed. This is achieved by severing the connection between the T-bar end and the runner bar. The attachment is severed from the runner bar by pushing the connecting part therebetween against a knife or cutting edge situated within the attacher, either on the needle itself or within the body of the attacher.

Conventional needles designed for use in these types of attachers include a shank portion which has a relatively sharp tip to permit penetration of the articles to be attached and a substantially cylindrical rear portion. The shank is hollow to permit the T-bar end of the attachment to pass therethrough and has a longitudinal slot to permit the filament of the attachment to extend therefrom as the T-bar end moves through the needle. The shank portion extends from a substantially cylindrical base having a central bore with an inner diameter equal to the inner diameter of the hollow shank. The base also has a longitudinal slot aligned with the slot in the shank. In needles which are removable from the attacher, the base is provided with means for correctly positioning the needle within the attacher and means for locking same into place.

Conventional needles of this type are produced commercially in two different ways. The base and shank may be machined from a single piece of metal. While this construction has the advantage of high strength, machining a single piece of metal into the required form is an arduous and time consuming task which results in a relatively expensive product. In order to reduce the cost of the needle, a second construction has been utilized. In this instance, the needle comprises two separate parts, a metal shank portion which is stamped from a flat sheet of metal and thereafter rolled into the desired configuration, and a plastic base part which is molded around the end of the shank portion. This construction results in a needle which is considerably less expensive than the all-metal, single-part construction. However, the two-part construction has considerably less strength than the single piece construction.

In both constructions, a knife edge is provided at the rear of the base section. In the single part construction, the knife edge, in the form of a "V"-shaped slot or the like, is machined into the rear of the base part. However, in the two part construction, the knife edge cannot be a part of the base because same is plastic and, thus, is not strong enough. Therefore, in order to provide the cutting edge in two part construction, the metal shank portion is formed with a rearwardly extending flat insert about which the base is molded. The insert extends along the entire length of the base. The "V"-shaped cutting edge is formed on the rear end of the insert and a recess is provided in the plastic of the rear of the base part adjacent the cutting edge to prevent interference of the base with the cutting operation. Thus, the cutting edge in the two-part construction is situated in the same position as the cutting edge in the single part construction. However, in the two-part construction, the cutting edge is located on the rearwardly extending metal insert which is a part of the shank portion, instead of being a part of the plastic base.

The base of the needle is locked within the body of the gun. When the gun is actuated, the plunger pushes the T-bar end of an attachment forwardly through the needle, causing the connection between the T-bar and the runner bar to be pushed against the knife edge and severed. In the single part construction, the severing of the connection between the T-bar and the running bar causes no problems because the cutting force is applied to the base which is secured to the gun.

However, in the two part construction, the forward directed cutting force is applied to the rearwardly extended insert which forms a part of the shank portion, not a part of the base. Thus, a forwardly directed force is applied to the shank portion, tending to move same relative to the stationary plastic base which is locked in the body of the gun. This causes a tendency for the metal shank portion to separate from the plastic base because of the oppositely directed forces developed therebetween.

This problem is particularly acute in attachers or guns which are power actuated because of the high magnitude of cutting force which is developed therein. It has, therefore, been found that the conventional two part construction is, in many cases, of insufficient strength to prevent separation of the shank portion from the base, resulting in a broken needle.

In addition, in both the single part and two part construction, the "V"-shaped cutting edge cannot be re-sharpened because of the inaccessibility thereof. For this reason, when the cutting edge becomes dull, the needle assembly must be discarded and replaced with a new needle assembly.

It is, therefore, a prime object of the present invention to provide a needle assembly which is as strong as the conventional single part machined needle.

It is a second object of the present invention to provide a needle assembly which is relatively inexpensive to manufacture.

It is a third object of the present invention to provide a needle assembly wherein the cutting edge is situated beyond the base to permit access thereto.

It is a fourth object of the present invention to provide a needle assembly wherein the cutting edge may be re-sharpened.

It is a further object of the present invention to provide a needle construction wherein the needle assembly includes separate metallic parts which are reliably secured together by an adhesive or the like.

It is a still further object of the present invention to provide a needle assembly wherein the needle is formed of separate metal parts, each of which is relatively inexpensive to manufacture.

In accordance with the present invention, a high strength needle assembly for dispensing fastener attachments having a sharpenable cutting blade is provided. The assembly comprises a shank part and a base part, the shank part including a tip portion and a substantially cylindrical hollow portion having an inner and an outer diameter. The base includes a central bore having first and second sections. The first section has an inner diameter substantially equal to the outer diameter of the cylindrical portion so as to permit insertion of the cylindrical portion therein. The second section has an inner diameter substantially equal to the inner diameter of the cylindrical portion. Means are provided for securing the outer surface of the cylindrical portion to the inner surface of the first section.

The cylindrical portion is provided with an end remote from the tip. This end has a substantially circular edge situated in a plane substantially perpendicular to the axis of the cylindrical portion. It is this end which is received and secured within the first section of the bore. The second section of the bore is considerably longer than the first section thereof, such that the cylindrical portion of the shank is inserted into the base only a relatively short distance.

A second aspect of the invention relates to the knife part thereof which is mounted on the base at a position thereon remote from the cylindrical portion of the needle assembly. The knife part includes an elongated body portion having a cutting edge situated on one end thereof. The other end of the body section is mounted on the base, such that the body portion extends beyond the base in a direction substantially parallel to the axis of the cylindrical portion.

The cutting edge preferably extends across the width of the outer end of the body portion and comprises a surface inclined between the faces of the body portion. The cutting edge is preferably provided with a notch therein to facilitate correct positioning of the attachment with respect to the cutting edge.

In one embodiment, means are provided for mounting the knife part to the base. The mounting means preferably comprises a recess on the base into which at least a portion of the inner end of the body portion is received. Preferably, the recess is adjacent the second section of the central base. The portion of the inner end of the knife which is received within the recess preferably comprises a protrusion which extends in a direction substantially parallel to the axis of the body portion. Means are provided for securing the protrusion within the recess. The securing means may comprise an adhesive or solder.

In a second embodiment, the knife is formed integrally with the base. Because the knife extends beyond the base, the cutting edge can be formed on the knife in a subsequent operation. The shank part can be secured to the base-knife part in the manner described above. This manufacturing method has the advantage of reduced cost, particularly when mass production techniques are utilized.

The present invention thus relates to a multiple part needle assembly wherein each part is relatively inexpensive to manufacture and the parts may be assembled in a manner which results in a high strength product. In addition, because the knife part extends beyond the base, the cutting edge is accessible, such that same may be re-sharpened.

To the accomplishment of the above, and to such other objects as may hereinafter appear, the present invention relates to a high strength needle assembly having a sharpenable cutting blade designed for use in dispensing fastener attachments or the like, as described in the following specification and recited in the annexed claims, taken together with the accompanying drawings, wherein like numerals refer to like parts, and in which:

Figure 1:
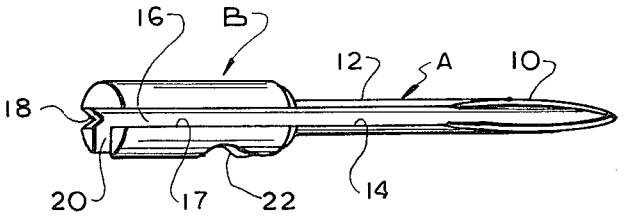
FIG. 1 PRIOR ART
FIG. 1 is a first side view of a needle having the prior art single part construction.
Figure 2:
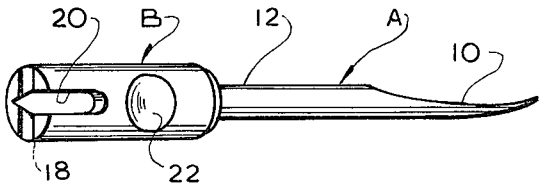
FIG. 2 PRIOR ART
FIG. 2 is a second side view of the needle shown in FIG. 1, but rotated a quarter turn to show portions hidden in FIG. 1.

FIGS. 1 and 2 illustrate the structure of a typical needle having the prior art single part construction. The needle is machined from a single piece of steel. The needle includes an elongated shank portion, generally designated A, integrally formed with a generally cylindrical base portion, generally designated B. Shank portion A comprises a relatively sharp tip 10 as its forward end and a generally cylindrical hollow portion 12 at its rearward end. Shank portion A is provided with a longitudinally extending slot 14. The hollow part of cylindrical portion 12 has an inner diameter which is somewhat larger than the outer diameter of the T-bar end of the attachment which will pass therethrough. The width of the slot 14 is large enough to accommodate the filament of the attachment.

Base portion B is provided with a central bore 16 which has an inner diameter substantially equal to the inner diameter of the hollow cylindrical portion 12 and is aligned therewith. On the rear end of base portion B is situated a "V"-shaped cutting edge 18 and a slot 20. Slot 20 is designed to permit part of the T-bar end of the fastener to feed into the needle. A slot 17 is provided along bore 16 and in alignment with slot 14 to permit the filament of the attachment to extend from the T-bar end as the latter is pushed through the needle. A generally circular recess 22 is formed on the side of base portion B. Recess 22 assures proper rotational positioning of the needle in the gun and cooperates with the locking mechanism in the gun such that the needle can be secured to the gun to prevent any relative movement therebetween.

Figure 3:
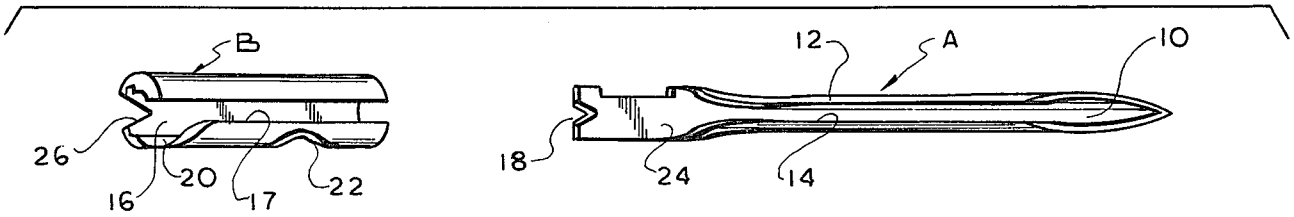
FIG. 3 PRIOR ART
FIG. 3 is a first exploded side view of a needle assembly having the two part prior art construction.
Figure 4:
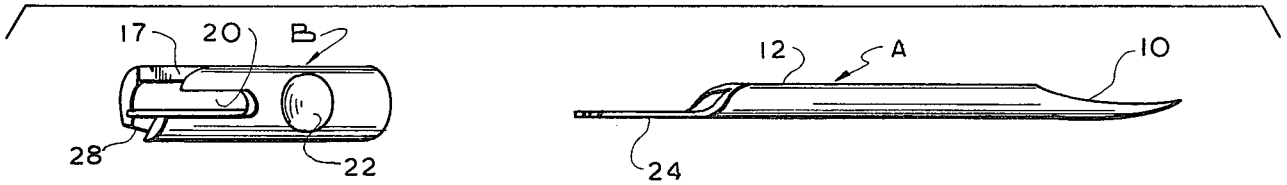
FIG. 4 PRIOR ART
FIG. 4 is a second exploded side view of the needle assembly shown in FIG. 3, but rotated a quarter turn to show portions hidden in FIG. 3.
Figure 5:
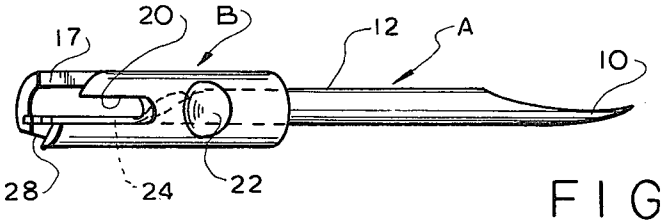
FIG. 5 PRIOR ART
FIG. 5 is a side view of the needle assembly shown in FIG. 3 in assembled form.

FIGS. 3, 4 and 5 illustrate a needle assembly having the conventional two part structure. In this case, the shank part A is stamped from a piece of steel and, thereafter, fashioned into the desired configuration. Base part B is formed of plastic which is molded around shank part A. More particularly, shank part A is formed with a rearwardly extending flat insert 24 which has the "V"-shaped cutting edge 18 at the rear end thereof. Base part B is molded around insert 24, as illustrated in FIG. 5, and is provided with a cutout 26 at the rear end thereof, situated to align with cutting edge 18, such that the base part B does not interfere with the cutting operation. Base part B is also provided with a bore 16, slot 17, slot 20, and recess 22, which provide the same functions as in the single part construction.

It will now be appreciated that when cutting forces are applied to cutting edge 18 in a needle assembly of two part construction, the forces are being applied to the shank part A, tending to move the shank part A forwardly, away from base part B, which is locked into the attacher. These forwardly directed forces tend to separate the shank part A from the base part B and, if strong enough, will result in a broken needle assembly.

Figure 6:
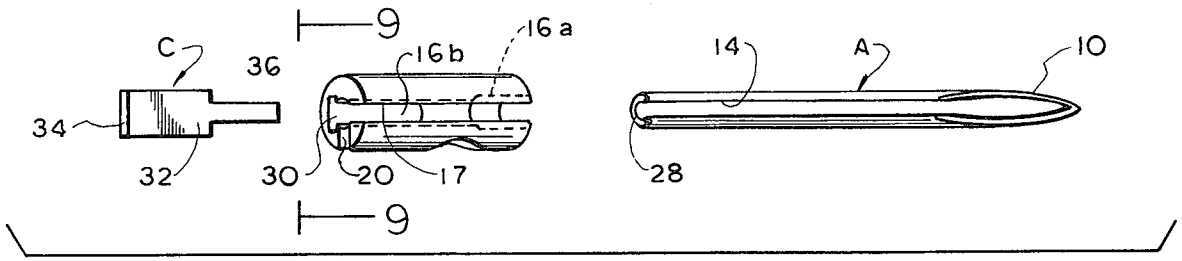
FIG. 6 is a first exploded side view of the needle assembly of the present invention.
Figure 7:
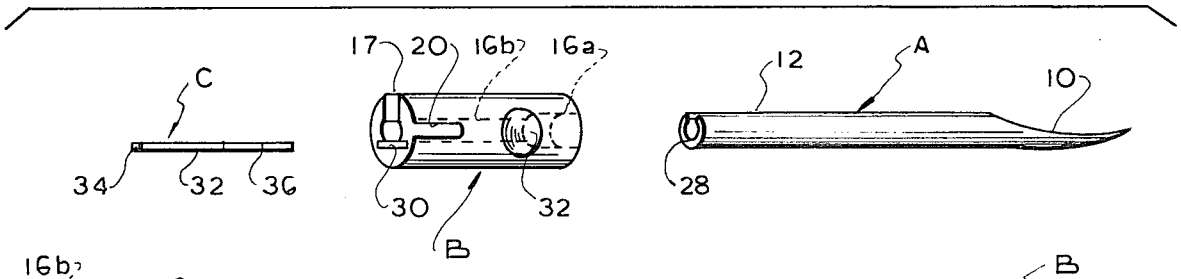
FIG. 7 is a second exploded side view of the needle assembly shown in FIG. 6, but rotated a quarter turn to show portions hidden in FIG. 6.
Figure 8:
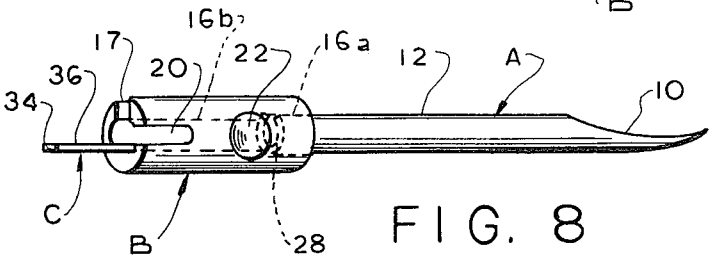
FIG. 8 is a side view of the needle assembly shown in FIG. 6 in the assembled condition.

FIGS. 6, 7 and 8 illustrate a first preferred embodiment of the needle assembly of the present invention. The needle assembly comprises a shank part A having a tip 10 and a cylindrical hollow body portion 12. However, unlike the shank part A of the prior art two part needle assembly, illustrated in FIGS. 3, 4 and 5, no rearwardly extending flat insert 24 is provided. In this case, the rearward end of the cylindrical portion 12 has a generally circular edge 28 which is situated in a plane substantially perpendicular to the axis of the cylindrical portion 12.

Base part B is provided with central bore 16 but, in this case, central bore 16 has two sections, 16*a* and 16*b*, of different inner diameter. Section 16*a* is designed as a seat for the rear end of cylindrical portion 12 of shank part A. The inner diameter of section 16*a* is substantially equal to the outer diameter of cylindrical portion 12, so as to permit insertion of the latter therein.

The second section 16*b* of the central bore has an inner diameter which is substantially equal to the inner diameter of the cylindrical portion 12 of shank part A. Thus, when shank part A is mounted to base part B, by inserting the rear end of cylindrical portion 12 into section 16*a* of the bore, a channel is formed to permit the T-bar end of the attachment to travel the length of the entire needle assembly. Slot 14 in shank part A and slot 17 in base part B are aligned, such that the filament may extend from the T-bar end as the latter passes through the needle assembly.

Figure 9:
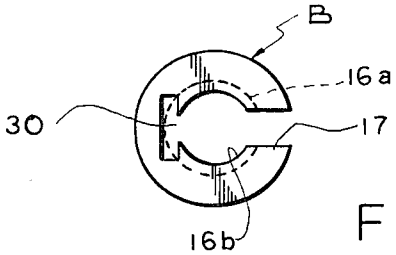
FIG. 9 is an end view of the needle assembly illustrated in FIG. 6, taken along line 9—9.

As best seen in FIG. 9, a recess 30 is provided in the rear end of base part B, preferably adjacent section 16*b* of the central bore. A knife part, generally designated C, is provided with a body section 32, a cutting edge 34 at one end of body section 32, and a protrusion 36 at the other end thereof. Protrusion 36 is adapted to be received within recess 30 and secured thereto to mount knife part C to base part B, such that same extends outwardly therefrom in a direction substantially parallel to the axis of the base and the cutting edge 34 is located beyond base B. Cutting edge 34 preferably extends across the width of body section 32.

As in the single part and two part constructions previously illustrated, the needle assembly of the present invention is also provided with slot 20 and recess 22 on the base part B thereof. Slot 20 and recess 22 serve the same functions in the needle assembly of the present invention as they did in the prior art constructions.

Figure 11:
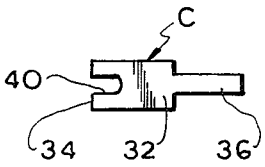
FIG. 11 is a second preferred embodiment of the knife part of the needle assembly of the present invention.
Figure 10:
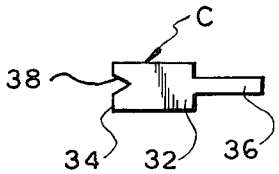
FIG. 10 is a top view of a first preferred embodiment of the knife part of the needle assembly of the present invention.

FIGS. 10 and 11 illustrate alternate embodiments of the knife part C. It is preferable to provide cutting edge 34 with a notch to facilitate positioning of the attachment with respect to the cutting edge. This slot can be in the form of a "V"-shaped slot 38, as illustrated in FIG. 10, or a "U"-shaped slot 40, as illustrated in FIG. 11.

Figure 12:
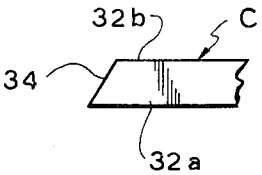
FIG. 12 is an enlarged side view of the knife part of the present invention, showing the cutting blade thereof.

FIG. 12 is an enlarged side view of knife part C. Elongated body section 32 comprises front and rear faces 32*a* and 32*b*. Cutting edge 34 comprises an inclined surface which extends between faces 32*a* and 32*b*. Preferably, the inclined surface which forms cutting edge 34 forms an angle of approximately 45° with the face 32*b*.

In the present invention, the shank part A is preferably stamped from a strip of high carbon steel. The base part B is preferably screw machined from a piece of low carbon bar stock steel. The knife part C can also be stamped from a piece of steel, but it is preferable to fashion same from stainless steel because stainless steel maintains a better edge for a longer period of time, does not break down and does not rust. By forming the knife part C and the base part B independently, it is possible, with the construction of the needle assembly of the present invention, to fashion each out of different types of steel, in accordance with the functional requirements of each.

Shank part A is secured to base part B and knife part C is secured to base part B by means of an adhesive or solder. One type of adhesive which has been found to function successfully is known as Kodak 910, available from the Eastman Kodak Company of Rochester, N.Y. However, various other adhesives or solders may be utilized to form the necessary bonds.

While it is preferable, for the reasons set forth above, to manufacture the knife part C separately from the base B and thereafter secure same together, this may not be economically feasible when the needles are mass produced in large quantities. In such situations, it may be more cost efficient to machine base B and knife part C from a single metal piece. When this production method is utilized, the cutting edge may be formed in a secondary operation. This is possible only when the knife part extends beyond the base such that the rear edge thereof, upon which the cutting edge is formed, is exposed.

Figure 13:
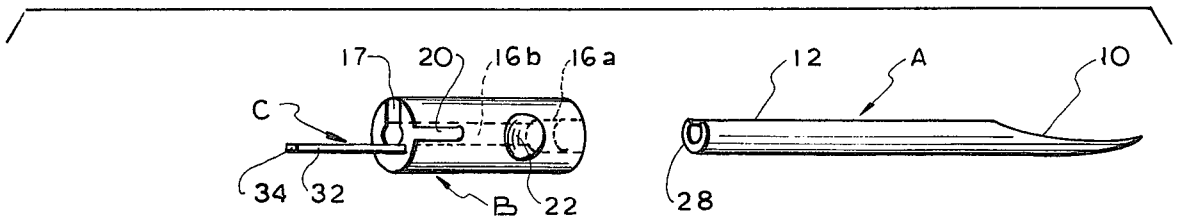
FIG. 13 is a side view of a second preferred embodiment of the present invention where the knife part is formed integrally with the base.

The embodiment with the single piece base-knife is illustrated in FIG. 13. This needle is quite similar in appearance to the preferred embodiment, and, in fact, has all the features thereof, except that the knife part C is formed integrally with the base part B from which it extends. The cutting edge 34 is formed after the base-knife part is machined by a conventional sharpening process. This operation can be performed before or after the shank part A is secured to the base-knife part, which is achieved in the same manner as in the preferred embodiment.

It will now be appreciated that the needle assembly of the present invention is as strong as a conventional single part machined needle, but is substantially less expensive to manufacture. The cutting edge is situated beyond the base to permit access thereto. Thus, the cutting edge may be re-sharpened when necessary. The assembly comprises a number of separate metal parts, each of which has a relatively simple structure and is relatively inexpensive to manufacture. The separate parts are reliably secured together by means of an adhesive or the like.

While only a limited number of preferred embodiments of the present invention have been disclosed herein for purposes of illustration, many variations and modifications could be made thereto. It is intended to cover all of these variations and modifications which fall within the scope of the present invention, as defined by the following claims.

I claim:

1. A needle assembly for use in a fastener attacher or the like comprising a shank part and a base part, said base part being adapted to be removably received in the fastener attacher, said shank part and said base part being independently fabricated, said shank part comprising a tip portion and a substantially cylindrical hollow portion having an inner and an outer diameter, said base part comprising a central bore having first and second sections, said first section having an inner diameter substantially equal to the outer diameter of said cylindrical portion so as to permit insertion of said cylindrical portion therein, said second section having an inner diameter substantially equal to the inner diameter of said cylindrical portion, and adhesive means for non-removably securing the outer surface of said cylindrical portion to the inner surface of said first section.

2. The assembly of claim 1, wherein said cylindrical portion has an end remote from said tip portion, said end having a substantially circular edge situated in a plane substantially perpendicular to the axis of said cylindrical portion.

3. The assembly of claim 2, wherein said end is received within said first section.

4. The assembly of claim 1, wherein said second section is longer than said first section.

5. The assembly of claim 1, further comprising a knife part mounted on said base part at a position remote from said first section of said bore.

6. The assembly of claim 1, further comprising a knife part, said base part being interposed between said cylindrical portion and said knife part.

7. The assembly of claim 1, further comprising a knife part mounted on said base part at a location adjacent said second section.

8. The assembly of claim 1, further comprising a knife part, said knife part comprising a body section and a cutting edge situated on one end of said body section, and adhesive means for non-removably securing said other end of said body section to said base part.

9. The assembly of claim 8, wherein said body section extends beyond said base part.

10. The assembly of claim 8, wherein said body section extends beyond said base part in a direction substantially parallel to the axis of said base part.

11. The assembly of claim 8, wherein said cutting edge extends across the width of said one end.

12. The assembly of claim 8, wherein said body section has front and rear faces and wherein said cutting edge comprises a surface inclined between said faces of said body section.

13. The assembly of claim 11, wherein said body section has front and rear faces and wherein said cutting edge comprises a surface inclined between said faces of said body section.

14. The assembly of claim 12, wherein said inclined surface makes an angle of approximately 45° with one of said faces.

15. The assembly of claim 8, wherein said one end of said body section has a notch therein.

16. The assembly of claim 1, further comprising a knife part and means for mounting said knife part to said base part.

17. The assembly of claim 16, wherein said mounting means comprises a recess on said base part into which at least a portion of one end of said knife part is received.

18. The assembly of claim 17, wherein said recess is situated adjacent said second section.

19. The assembly of claim 17, wherein said portion of said one end of said knife part comprises a protrusion.

20. The assembly of claim 19, wherein said protrusion extends in a direction substantially parallel to the axis of said body section.

21. A needle assembly for dispensing fasteners or the like comprising first and second parts, said first part comprising a substantially cylindrical base with a central bore and an elongated body formed integrally with said base and extending outwardly therefrom, said body having a cutting edge on one end thereof, said second part comprising a shank having a cylindrical portion, a part of which is adapted to be received within said central bore and means for securing said first part to said second part.

22. The assembly of claim 21, wherein said central bore has first and second sections, said first section having an inner diameter substantially equal to the outer diameter of said cylindrical portion.

23. The assembly of claim 22, wherein said cylindrical portion has an end having a substantially circular edge situated in a plane substantially perpendicular to the axis of said cylindrical portion.

24. The assembly of claim 23, wherein said end of said cylindrical portion is received within said first section.

25. The assembly of claim 23, wherein said second section is longer than said first section.

* * * * *